United States Patent [19]

Anderton et al.

[11] 4,366,780

[45] Jan. 4, 1983

[54] METHOD OF OPERATING VEHICLE DURING ITS IN-PLANT ASSEMBLY

[75] Inventors: Raymond A. Anderton, Maldon; Raymond R. Smith, Hawkwell; Robert S. Tippler, Chelmsford, all of England

[73] Assignee: Ford Motor Company, Dearborn, Mich.

[21] Appl. No.: 243,977

[22] Filed: Mar. 16, 1981

[51] Int. Cl.[3] ..... F02B 75/12

[52] U.S. Cl. ..... 123/1 A; 44/58

[58] Field of Search ..... 123/1 A; 44/58

[56] References Cited

U.S. PATENT DOCUMENTS

| | | | |
|---|---|---|---|
| 1,183,038 | 5/1916 | Schlaepfer | 123/1 A |
| 2,409,157 | 10/1946 | Schulze et al. | 123/1 A |
| 2,727,496 | 12/1955 | Thomas | 123/1 A |
| 2,789,891 | 4/1957 | Brandes et al. | 44/58 |
| 2,811,145 | 10/1957 | Young | 123/1 A |
| 2,862,481 | 12/1958 | Rounds et al. | 123/1 A |
| 3,390,083 | 6/1968 | Lion | 44/58 |
| 3,753,905 | 8/1973 | Souillard et al. | 44/58 |
| 3,888,776 | 6/1975 | Silverstein | 44/58 |

FOREIGN PATENT DOCUMENTS

| | | | |
|---|---|---|---|
| 843169 | 8/1960 | United Kingdom | 44/58 |

*Primary Examiner*—Charles J. Myhre
*Assistant Examiner*—E. Rollins Cross
*Attorney, Agent, or Firm*—Joseph W. Malleck; Olin B. Johnson

[57] ABSTRACT

In vehicle assembly plants or storage depots, newly assembled motor vehicles having spark ignition, internal combustion engines are driven under their own power between several locations separated from each other by short distances, the engine being allowed to cool in each location. Fouling of the spark plugs is reduced by using a gasoline fuel composition (e.g., 95–98 Octane) containing a small proportion (usually 0.2–10% by volume, preferably 0.4%) of a mineral oil, e.g., engine lubricating oil.

6 Claims, 1 Drawing Figure

METHOD OF OPERATING VEHICLE DURING ITS IN-PLANT ASSEMBLY

BACKGROUND OF THE INVENTION

In assembly plants or storage depots, newly assembled vehicles are usually driven under their own power between several locations all within a short distance of each other. As a result, the vehicle engine runs for very short intervals with a fuel rich mixture at temperatures well below its normal operating temperature (50–70% of normal operating temperature, i.e., 350°–400° C. at plug tip).

In spark ignition internal combustion engines, such operation frequently leads to fouling of the engine spark plugs by carbon and unburnt fuel deposition on electrodes as result of imperfect combustion. This is to be distinguished from gum deposits which form as fuel residue and cannot be burnt away at normal operating temperatures. The fouling provides difficulties in moving vehicles within the plant or depot. Additionally, when the vehicle is delivered to the retailer, it is often necessary to fit a new set of spark plugs to the engine before the vehicle is sold to the customer. This adds to the final cost of the vehicle.

This invention relates to methods of operating newly assembled motor vehicles in vehicle assembly plants or storage depots.

SUMMARY OF THE INVENTION

According to the present invention, there is provided a method of operating a newly assembled vehicle in a vehicle assembly plant or storage depot, the vehicle having a spark ignition internal combustion engine and comprising driving the vehicle under its own power with a fuel-rich mixture between a plurality of locations within the plant and switching off the engine when the vehicle is at rest in the locations, characterized in that the engine is driven from a fuel composition containing a gasoline fuel and a minor proportion of a mineral oil.

We have found that the addition of a minor proportion of mineral oil to the fuel composition significantly reduces the risk of fouling of spark plugs in newly assembled vehicles operated in plants or depots.

DETAILED DESCRIPTION

Figure 1:
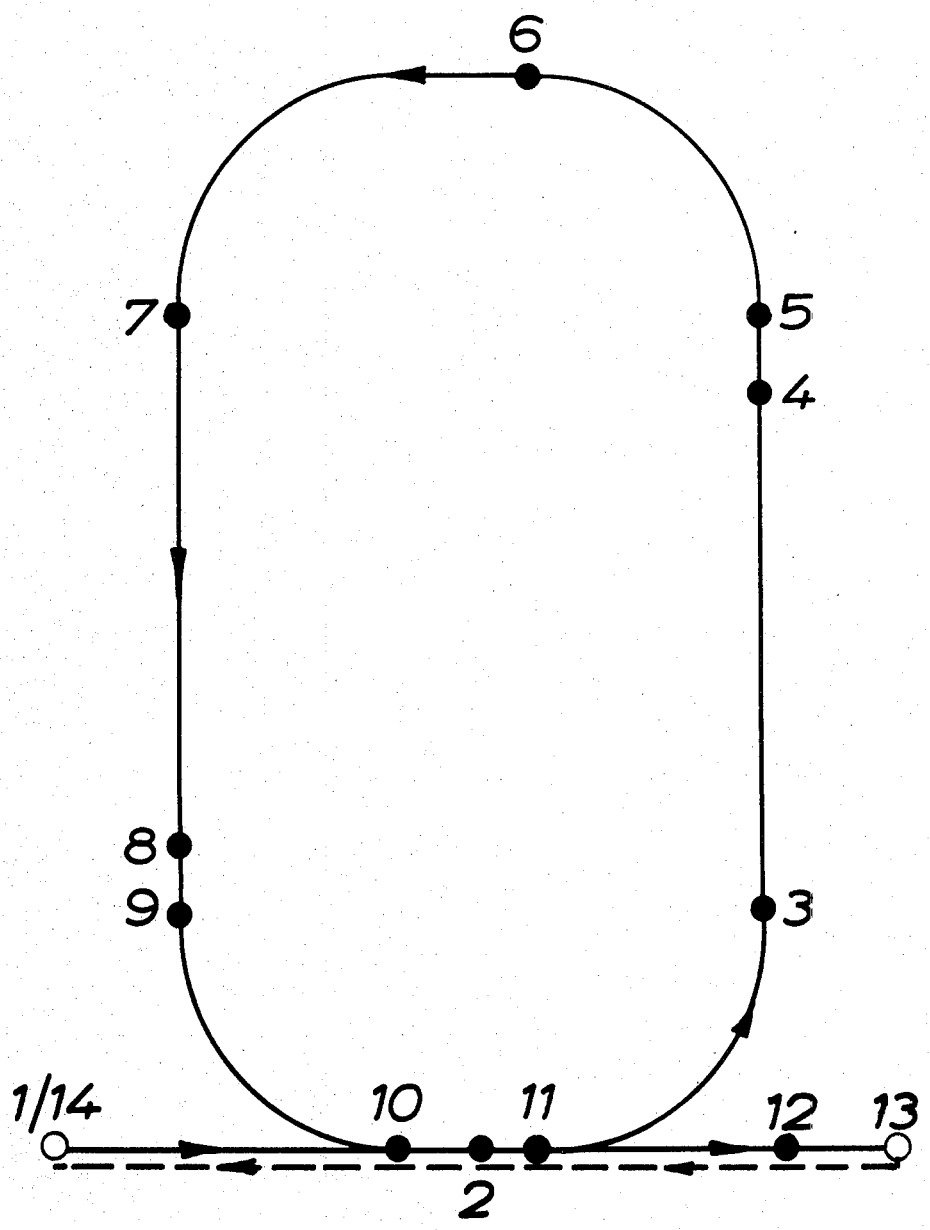
FIG. 1 is a schematic diagram of an in-plant driving cycle used to test the performance of the fuel mixture of this invention.

It is well known to use fuel compositions containing so-called upper cylinder lubricants when driving the vehicle under normal conditions and some fuel additives used for this purpose do contain mineral oil. However, such fuel compositions are not used in newly assembled vehicles because the benefit of upper cylinder lubrication is only obtained when the vehicle is driven for prolonged periods.

The benefit of the invention can be obtained using any mineral oil heavier or more viscous than gasoline. Viscosity of oil is determined by use of a viscosimeter, a device that determines the length of time required for a definite amount of oil to flow through an opening of a definite diameter. Temperature is taken into consideration during this test, since high temperature decreases viscosity and low temperature increases viscosity. The viscosity of the additive should be greater than 15 SUS (Saybolt Universal Seconds) at 100° F. (37.8° C.), which is roughly the viscosity of conventional gasoline. The oils preferably suggested to be used are standard engine lubricating oils having a viscosity of 24–1500 SUS at 100° F. (37.8° C.), or a viscosity classified by the U.S. Society of Automotive Engineers (SAE J300D). In referring to viscosity, the lower numbers refer to oils of lower viscosity (thinner). The Society of Automotive Engineers rates oil viscosity in two different ways, for winter and for other than winter. Winter-grade oils are tested at 18° C. There are three winter grades, SAE5W, SAE10W, and SAE20W, the "W" indicating winter grade. For other than winter use, the grades are SAE20, SAE30, SAE40 and SAE50, all without the "W" suffix. Some oils have multiple ratings, which means they are equivalent in viscosity to several single-rating oils. An SAE10W-30 oil, for example, is comparable to SAE10W, SAE20W and SAE30 oils.

| SAE GRADE | |
|---|---|
| | MAX VISCOSITY IN CENTIPOISE at 18° C. |
| 5W | 1250 |
| 10W | 2500 |
| 20W | 10000 |
| | VISCOSITY RANGE IN CENTISTOKES at 100° C. |
| 20 | 5.9–9.3 |
| 30 | 9.3–12.5 |
| 40 | 12.5–16.3 |
| 50 | 16.3–21.9 |

For example, we have found that the incorporation of heavy fuel oils such as diesel oil in the gasoline reduces in-plant fouling. Preferably, however, the mineral oil is a petroleum based lubricating oil, and motor vehicle engine oils are especially suitable.

Any minor proportion of mineral oil is included in the composition, 0.2–10% by volume. Preferably, however, the mineral oil constitutes less than 5% by volume thereof to reduce the amount of pollutants emitted in the engine exhaust fumes. In this respect, the most satisfactory results have been obtained using 0.4% by volume of mineral oil.

Any gasoline suitable for spark ignition internal combustion engines may be used. Standard gasoline fuels having Research Octane Numbers of from 90 to 100, and preferably from 95 to 98, will normally be appropriate.

The following examples illustrate the invention:

Using the fuel composition identified in Table II below, a motor vehicle was subjected to the test procedure described below which simulates the conditions under which newly assembled motor vehicles are driven between various locations in a vehicle assembly plant or storage depot.

The motor vehicle was a Ford Escort (Registered Trademark) saloon car having a conventional, manual-transmission, 4-cylinder, spark ignition, internal combustion engine fed by a carburetor fitted with a manually operated choke control. The engine was fitted with standard AGR 22 spark plugs.

Prior to each test procedure, the engine was fitted with clean spark plugs and the fuel tank was drained and then filled with the test fuel composition. The carburetor was adjusted so that the choke control has no effect upon the position of the throttle control and the idle jet was adjusted to produce an idle speed of 800-50 revolutions per minute with the engine at ambient temperature.

The vehicle was then driven around the circuit illustrated in the drawing starting point 1 and passing through points 2 to 14 in numerical order. The total length of the circuit was 0.1 miles (0.15 kn). Table 1 summarizes the routines performed at points 1 to 14 in the circuit.

TABLE I

| Point No. | Routine |
|---|---|
| 1 | (i) Measure shunt resistance of spark plugs while installed in the engine<br>(ii) Pull choke control to ensure that choke butterfly is fully shut<br>(iii) Switch on ignition<br>(iv) Fully depress throttle pedal twice<br>(v) Start engine<br>(vi) Allow time for oil light to go out then engage bottome (1st) gear and immediately drive gently away. |
| 2 | (i) Engage second gear<br>(ii) Accelerate gently |
| 3 | (i) Engage third gear<br>(ii) Fully depress throttle pedal immediately clutch is released |
| 4 | (i) Release throttle pedal<br>(ii) Apply brakes in preparation for taking corner<br>(iii) Engage second gear |
| 5 | Drive round corner in second gear with trailing throttle |
| 6 | Drive gently in second gear |
| 7 | (i) Engage third gear<br>(ii) Fully depress throttle pedal immediately clutch is released. |
| 8 | (i) Release throttle pedal<br>(ii) Apply brakes in preparation for taking corner<br>(iii) Engage second gear |
| 9 | Drive round corner in second gear with trailing throttle |
| 10 | Drive gently in second gear |
| 11 | (i) Engage third gear<br>(ii) Fully depress pedal immediately clutch is released |
| 12 | (i) Release throttle pedal<br>(ii) Apply brakes and bring car to a standstill |
| 13 | (i) Engage reverse gear<br>(ii) Gently reverse into bay |
| 14 | (i) With gearbox in neutral and clutch engaged, note engine idle speed, if (a) less than 1200 rev/min, blip throttle to obtain 1200 rev/min and immediately switch off ignition, if (b) greater than 1200 rev/min, switch off ignition immediately.<br>(ii) Measure shunt resistances of spark plugs while installed in the engine.<br>(iii) Allow engine to cool for at least one hour. |

The vehicle was repeatedly subjected to the test drive until one or more of the spark plugs stopped firing and failed to fire agin. This normally occurred either when attempting to start the engine at the beginning of a test drive or when third gear had been engaged and the vehicle was being driven with the carburetor throttle wide open, when the engine misfired. The shunt resistance of failed spark plugs was usually less than 0.5 megohms.

Table II summarizes the number of circuits performed by the vehicle until one or more of the spark plugs failed. Examples A to G are without additive oil for comparison purposes.

TABLE II

| Example No. | Spark Plug Gap (mm) | Gasoline Type | Numeral Oil Type | % By Vol. Numeral Oil | No. of Test Cycles Before Fouling |
|---|---|---|---|---|---|
| A | 0.8 | (1) Texaco BS4040 "4-star" 98 R.O.N. | — | — | 9 |
| B | " | (1) Texaco BS4040 "4-star" 98 R.O.N. | — | — | 4 |
| C | " | (2) Esso BS4040 "4-star" 98 R.O.N. | — | — | 10 |
| D | " | (2) Esso BS4040 "4-star" 98 R.O.N. | — | — | 9 |
| E | " | (3) Esso BS4040 "3-star" 95 R.O.N. | — | — | 16 |
| F | " | (3) Esso BS4040 "3-star" 95 R.O.N. | — | — | 8 |
| G | " | (3) Esso BS4040 "3-star" 95 R.O.N. | — | — | 6 |
| H | " | Esso BS4040 "4-star" | — | — | 6 |
| I | " | Esso BS4040 "4-star" | — | — | 9 |
| 1 | " | Texaco BS4040 "3-star" 95 R.O.N. | Texaco Based Oil(4) 1050 SUS at 37/8° C. (100° F.) | 5 | 20 |
| 2 | " | Esso BS4040 "3-star" 95 R.O.N. | Esso Bright Stock(5) 530mm²/sec. at 37.8° C. | 5 | 19 |
| 3 | " | Esso BS4040 "3-star" 95 R.O.N. | Esso Bright Stock(5) 530mm²/sec. at 37.8° C. | 5 | 18 |
| 4 | " | Esso BS4040 "3-star" 95 R.O.N. | Esso Bright Stock(5) 530mm²/sec. at 37.8° C. | 5 | 20 |
| 5 | " | Texaco BS4040 "4-star" 98 R.N. | Texaco 20/30 engine lub. oil | 25 | None after 18. |
| 6 | " | Texaco BS4040 "4-star" 98 R.N. | Texaco 20/30 engine lub. oil | 10 | None after 18. |
| 7 | " | Texaco BS4040 "4-star" 98 R.N. | Texaco 20/30 engine lub. oil | 5 | 11 |
| 8 | " | Texaco BS4040 "4-star" 98 R.N. | Texaco based oil w/Texaco viscosity improvement | 4 | None after 19. |
| 9 | " | Texaco BS4040 "4-star" 98 R.N. | Esso Stanco-600 grade engine oil 130mm²/sec. at 37.8° C. | 4 | 27 |

TABLE II-continued

| Example No. | Spark Plug Gap (mm) | Gasoline Type | Numeral Oil Type | % By Vol. Numeral Oil | No. of Test Cycles Before Fouling |
|---|---|---|---|---|---|
| 10 | " | Texaco BS4040 "4-star" 98 R.N. | Esso Stanco-130 grade engine oil 25mm²/sec. | 10 | 20 |
| 11 | " | Texaco BS4040 "4-star" | Esso Stanco 2500 grade eng. oil 550mm²/sec. at 37.8° C. | 0.1 | 14 |
| 12 | " | Texaco BS4040 "4-star" | Esso Stanco 2500 grade eng. oil 550mm²/sec. at 37.8° C. | 0.2 | 20 |
| 13 | " | Texaco BS4040 "4-star" | Esso Stanco 2500 grade eng. oil 550mm²/sec. at 37.8° C. | 0.4 | 27 |
| 14 | " | Texaco BS4040 "4-star" | Esso Stanco 2500 grade eng. oil 550mm²/sec. at 37.8° C. | 0.8 | 22 |
| 15 | " | Texaco BS4040 "4-star" | Esso Stanco 2500 grade eng. oil 550mm²/sec. at 37.8° C. | 2.0 | 17 |

Footnotes to Table II
(1), (2) "Esso and "Texaco" are registered trademarks.
(3) "R.O.N." means Research Octane Number.
(4), (5)Texaco Base Oil and Esso Bright Stock base oils used for commercial grades of engine lubricating oil.

On comparing the test results obtained in Examples 1 to 16 with those of the comparative Examples A to H, it can clearly be seen that the addition of an adequate quantity of mineral oil to the gasoline based fuel composition reduced the frequency of spark plug fouling. A proportion of 0.2–10% by volume of mineral oil showed the best results and mineral oils with a viscosity of 25–550 mm² per second at 37.8° C. (100° F.) worked particularly well.

We claim:

1. A method of operating a newly assembled vehicle in a vehicle assembly plant or storage depot, the vehicle having a spark ignition internal combustion engine and comprising driving the vehicle under its own power with a fuel-rich mixture between a plurality of locations within the plant and switching off the engine when the vehicle is at rest in the locations so that the engine is operated at 50–70% of normal operating temperatures, characterized in that the engine is driven from a fuel composition containing a gasoline fuel and a proportion of a mineral oil exceeding 0.2% by volume of the mixture and having a viscosity exceeding said gasoline.

2. A method according to claim 1, wherein the gasoline fuel comprises a 90 to 100 Research Octane Number fuel.

3. A method according to claim 1, wherein the gasoline fuel comprises a 95 to 98 Research Octane Number fuel.

4. A method according to any claim 1, 2 or 3, wherein the mineral oil comprises a petroleum based lubricating oil having a viscosity in the range of 25–1500 SUS at 37.8° C. (100° F.).

5. A method according to any claim 1, 2, or 3, wherein the mineral oil comprises a motor vehicle engine oil having a maximum viscosity in the range of 25–550 mm²/sec. at 37.8° C. (100° F.).

6. A method according to any claim 1, 2, or 3, wherein the mineral oil comprises 0.2–10% by volume of the fuel composition.

* * * * *